United States Patent [19]

Jones

[11] 4,184,397

[45] Jan. 22, 1980

[54] FOOD SLICER

[75] Inventor: Frank W. Jones, Wilmington, Del.

[73] Assignee: Redco, Inc., Wilmington, Del.

[21] Appl. No.: 907,158

[22] Filed: May 17, 1978

[51] Int. Cl.[2] ..... B26D 4/02

[52] U.S. Cl. ..... 83/874; 83/425.3; 83/858

[58] Field of Search ..... 83/874, 425.3, 425.2, 83/435, 858, 856; 83/874, 425.3, 425.2, 435, 858, 856

[56] References Cited

U.S. PATENT DOCUMENTS

| | | | |
|---|---|---|---|
| 503,903 | 8/1893 | Curtis | 83/407 |
| 982,366 | 1/1911 | Hungerford | 83/425.3 |
| 1,068,123 | 7/1913 | Hager | 83/858 X |
| 2,009,913 | 7/1935 | Bever | 83/874 |
| 3,369,582 | 2/1968 | Giangiulio | 99/537 |
| 3,605,839 | 9/1971 | Gerson | 83/425.3 |
| 3,807,266 | 4/1974 | Camp | 83/425.3 |
| 3,942,399 | 3/1976 | Giangiulio | 83/874 |

*Primary Examiner*—Frank T. Yost
*Attorney, Agent, or Firm*—Connolly and Hutz

[57] ABSTRACT

A device for slicing tomatoes and other soft food objects has a hollow triangular enclosure frame with three vertical sides disposed about an open interior into which tomatoes are inserted. The longest vertical side or hypotenuse side of the vertical frame enclosure carries a tensioned rack of parallel blades with sharp cutting edges facing inwardly. The opposite intermediate length side of the frame has a pusher sliding back and forth along it with spaced fingers inserted between the opposite cutting blades. Insertion of tomatoes is facilitated by a vertically movable loading platform mounted within the frame which can be manually raised by a push rod at the top to receive a tomato and then lowered below the path of movement of the pusher to permit the pusher to traverse the tomato along and through the cutting edges of the blades to slice it. The loading platform has a table rotatably mounted at the top of a lifting lever which is rotatably mounted at the bottom of the frame.

13 Claims, 3 Drawing Figures

FOOD SLICER

BACKGROUND OF THE INVENTION

Various devices are available for slicing tomatoes and other soft food objects by utilizing a pusher with spaced fingers for pushing the tomato at an angle along and between a rack of sharp parallel spaced blades. Such devices are enhanced by holding the blades as rigidly as possible, making them simple, free-acting and dependable.

SUMMARY OF THE INVENTION

In accordance with this invention a device for slicing tomatoes and other similar soft food objects has a vertical triangular frame enclosure with a spaced rack of parallel cutting blades mounting in the longest side with a pusher sliding back and forth on the opposite side. Spread fingers of the pusher are inserted through the blades whose cutting edges face inwardly. A tomato is dropped into the space in front of the pusher when it is disposed adjacent the wider part of the frame, and it is pushed along and through the blades to slice it when the pusher is slid to the apex of the triangular space. The tomato is conveniently dropped into position on a movable loading platform which is raised up within the frame to receive the tomato and drop down clear of the pusher for traversal through the blades to slice it. The loading platform may utilize a table rotatably mounted on top of an elevating lever which is pivoted at the bottom of the frame.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which.

DESCRIPTION OF THE PREFERRED EMBODIMENT

Figure 2:
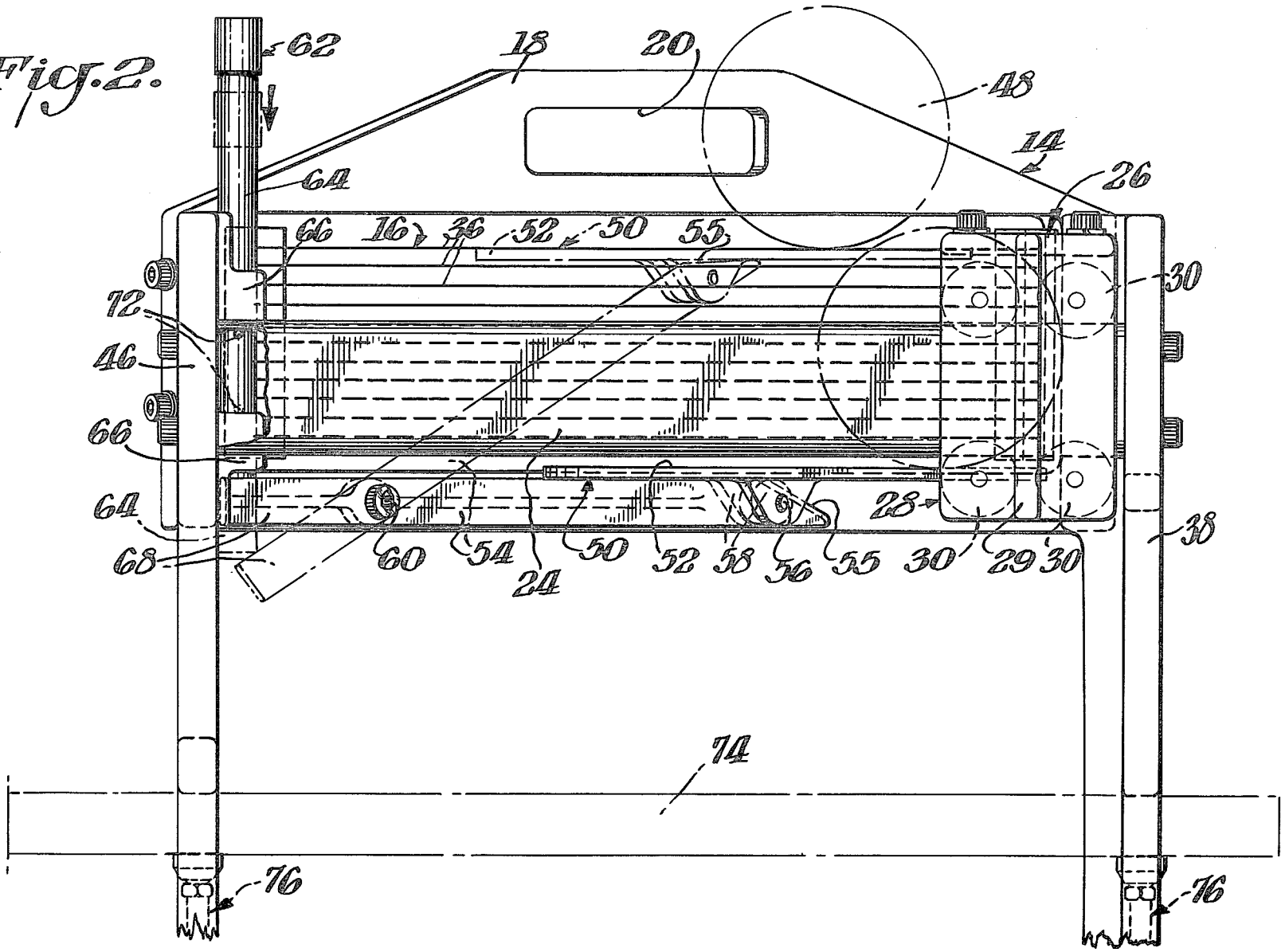
FIG. 2 is a side elevational view of the slicer shown in FIG. 1 with the loading platform shown in dropped position in full outline and in raised position in phantom outline.
Figure 1:
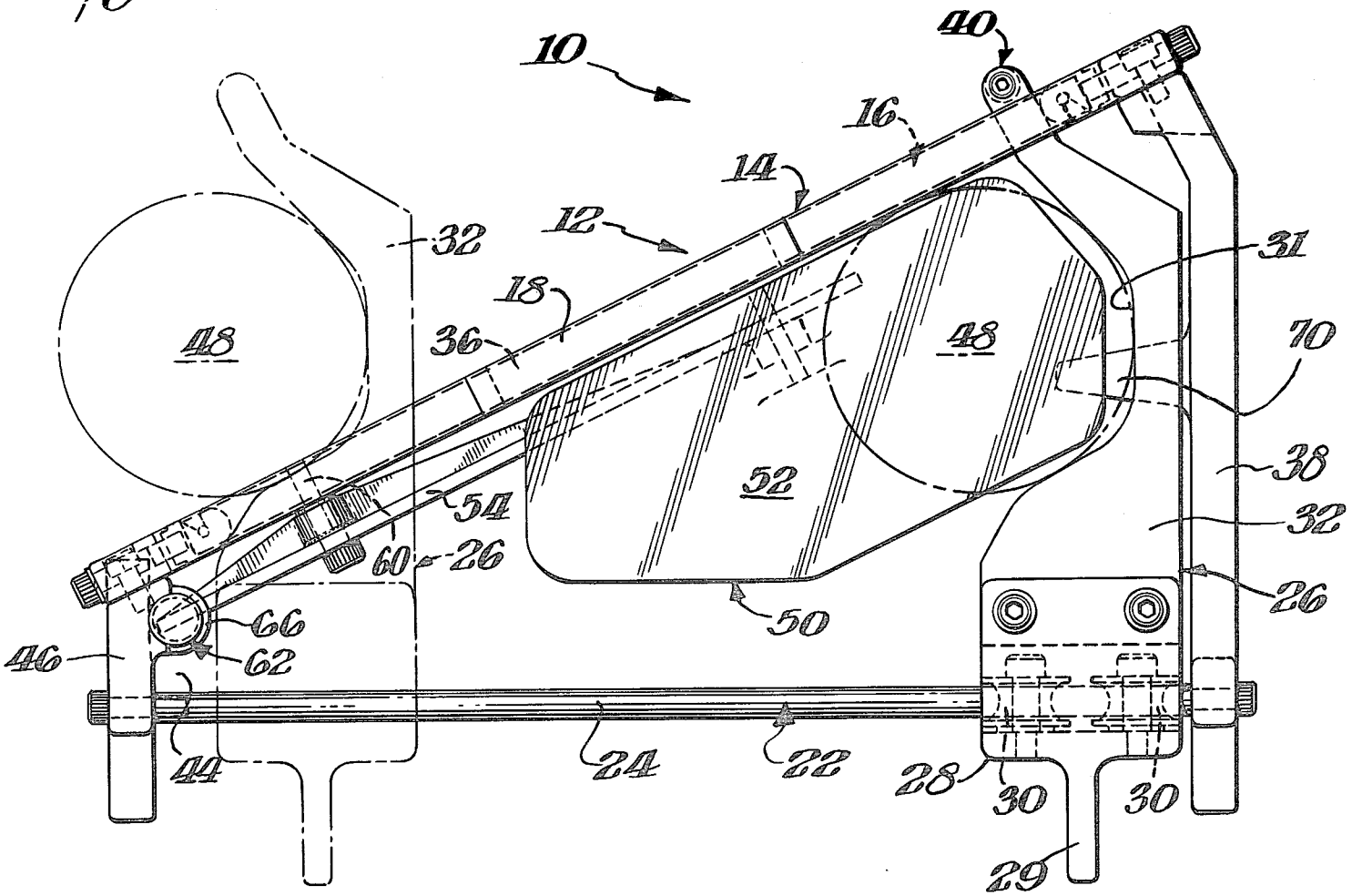
FIG. 1 is a top plan view of a tomato slicer, with pusher shown in the open position in full outline and in the closed position in phantom outline, which is one embodiment of this invention.
Figure 3:
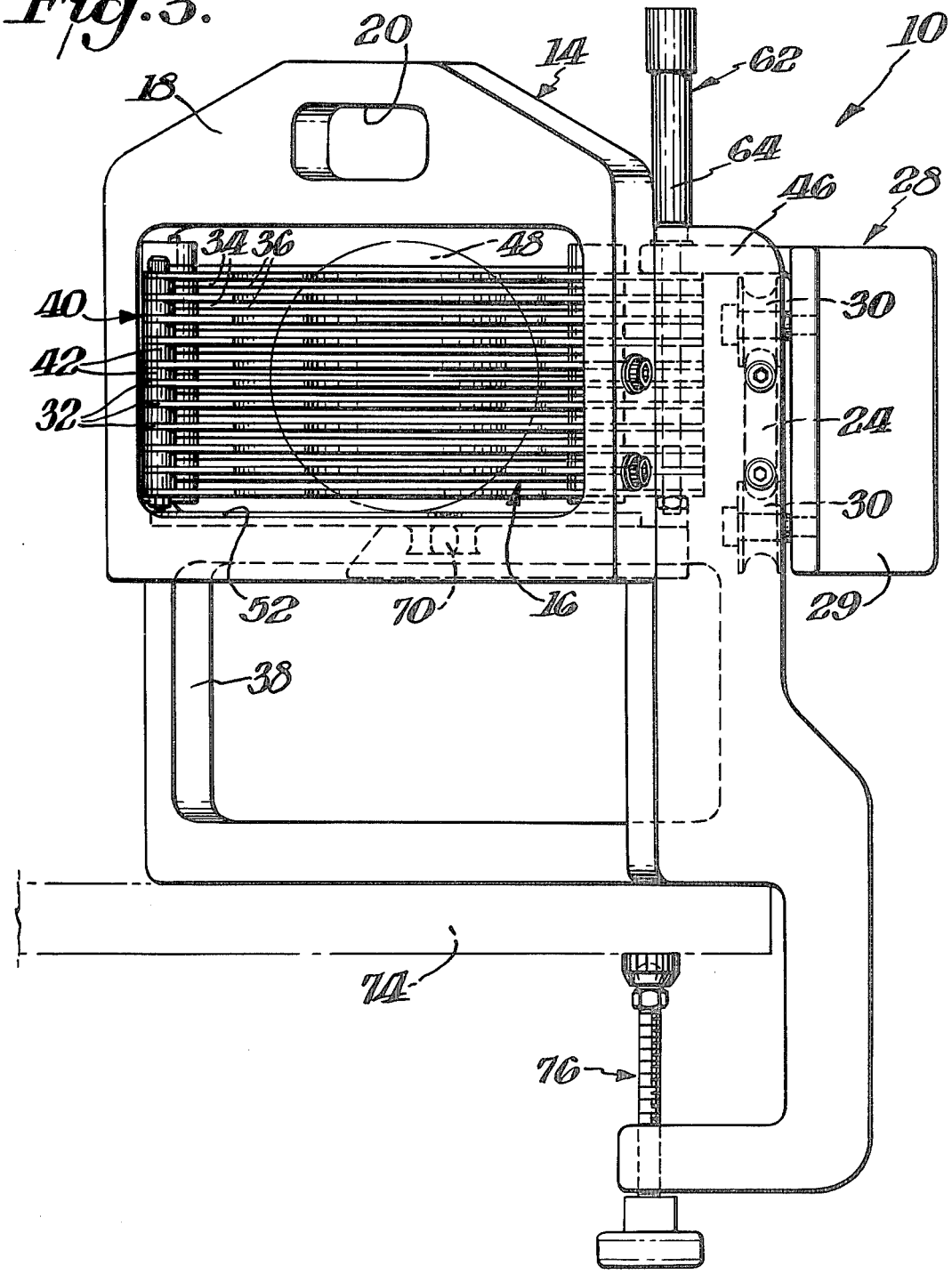
FIG. 3 is a left end elevational view of the slicer shown in FIGS. 1 and 2.

In FIG. 1 is shown a tomato slicer 10 having a triangular enclosure frame 12 substantially comprising three sides. Referring to FIGS. 1, 2 and 3, hypotenuse or longer side 14 has a tensioned rack of parallel cutting blades 16 mounted in a substantially rectangular side frame 18 having a carrying handle 20 on top of it. The opposite side 22 has a slide guide 24 mounted substantially across its middle. Segmented pusher 26 has its base 28 mounted to slide back and forth along guide bar 24 by engagement of mounting rollers 30 with the top and bottom of guide bar 24. Pusher 26 has spaced fingers 32 extending across the hollow interior of the enclosure frame 12 and through spaces 34 between blades 36. Fingers 32 are just long enough to extend through blades 36 when pusher 26 is adjacent the shorter side or base 38 of triangular enclosure frame 12 and are secured rigidly together by a bracing rod 40 in conjunction with suitable spacing bushings 42.

Apex 44 of triangular enclosure frame 12 is secured together by an apex connector 46 attached to the end of hypotenuse side 14 and opposite side 22. The resultant angle between slide bar 22 and cutting blades 16 is approximately 30° . It is obvious that such angle may be varied to provide sufficient operating space to accommodate a variety of sizes of tomatoes.

A tomato 48 may be inserted into operating position, as shown in FIGS. 1–3, by placing it on loading platform 50 when it is raised to its upper portion, shown in FIG. 2 in phantom outline. Loading platform 50 has a receiving table 52 rotatably connected to the top of elevating lever 54 by pin 56 inserted through table lugs 58 and the upper end of elevating lever 54. The lower end of elevating lever 54 is rotatably mounted by pivot 60 to the bottom of hypotenuse side 14 below rack of cutting blades 16 and the path of movement of pusher 26.

Operating lever 62 is actuated against the return force of gravity by vertical push rod 64 mounted on apex connector 46 in apex 44 of frame 12 within guide bushings 66 secured inside apex connector 46. Downward pressure on push rod 64 against the lower end 68 of lever 54 raises loading table 50 to the raised position shown in FIG. 2 for receiving a tomato 48. When push rod is released, the weight of lever 54 and loading platform assembly 50 drops, with or without a tomato on table 52, to the lower or operating position, shown in full outline in FIG. 2. The lower position of table 52 is defined by a stop 70 mounted near the bottom of base side 38 of frame 12. The upper and lower movement of push rod 64 is governed by stop pin 72 that engages the guide bushings 66. Most of the components making up frame 12 are conveniently fabricated of castings of noncorrodable metals, such as aluminum and suitable alloys. Cutting blades 36 are effectively made of a type of stainless steel which is capable of holding a sharp edge.

Slicer 10 is conveniently mounted for use by securing the two ends 38 and 46 of slider side 22 to support table 74 by C-clamp screw assemblies 76. An operator may also steady the device by grasping handle 20.

Pusher 26 has an operating handle 29 extending outside of guide bar 24. Table 52 is held in a raised horizontal position for receiving a tomato 48 by retension on angled edge 55 of lever 54. Inclined edges 55 rotate downwardly clear of table 50 in the lowered position to allow it to guide the tomato downwardly into the lower position, shown in phantom outline in FIG. 2, with table 52 below the path of movement of pusher 26 and resting on stop 70.

Tomato 48 is sliced by grasping pusher handle 29 and moving it from the open position shown in full outline in FIG. 1 to the closed position as shown in the phantom outline. Tomato 48 is accordingly urged by concavity 31 in segmented fingers 32 of pusher 26, and forced through spaces 34 between cutting blades 36 to ultimately eject its slices near apex 44 of frame 12.

I claim:

1. A device for slicing a food object comprising a substantially vertical hollow triangular enclosure frame having a substantially wedge-shaped interior space bounded by three sides, two of the sides being relatively long and one being relatively short, a longer side carrying a rack of parallel cutting blades having sh p edges disposed inwardly towards the interior of the frame, an other longer side being disposed opposite the cutting blades, the short side joining adjacent ends of the longer side to each other at a distance sufficient to allow the food object to be received within the interior of the frame adjacent the short side, a segmented pusher having spaced fingers inserted between the blades and within the short side, a slide connector connecting the pusher to the other longer side for movement back and forth along its length, the fingers being long enough to maintain them inserted through the cutting blades while the pusher is traversed across the interior of the frame whereby an object disposed in front of the pusher is pushed across and through the blades to slice it.

2. A device as set forth in claim 1 wherein a handle is connected to the pusher extending outwardly from the frame for manual actuation of the pusher.

3. A device for slicing a food object comprising a substantially vertical hollow triangular enclosure frame having a substantially wedge-shaped interior space bounded by three sides, two of the sides being relatively long and one being relatively short, a longer side carrying a rack of parallel cutting blades having sharp edges disposed inwardly towards the interior of the frame, an other longer side being disposed opposite the cutting blades, the short side joining adjacent ends of the longer side to each other at a distance sufficient to allow the food object to be received within the interior of the frame adjacent the short side, a segmented pusher having spaced fingers inserted between the blades, a slide connector connecting the pusher to the other longer side for movement back and forth along its length. the fingers being long enough to maintain them inserted through the cutting blades while the pusher is traversed across the interior of the frame whereby an object disposed in front of the pusher is pushed across and through the blades to slice it, a vertically movable loading platform is mounted on a lower portion of the frame for movement from a raised position relative to the interior of the frame for conveniently receiving a food object to a lower position disposed within the interior of the frame below the path of movement of the pusher whereby an object is loaded into position to be sliced.

4. A device as set forth in claim 3 wherein the movable loading platform comprises a loading table, an elevating lever, pivotal means connecting the table to the top of the elevating lever, pivot means connecting the lever to the frame below the path of movement of the pusher and actuating rod means mounted on the frame and operatively connected to the end of the lever opposite the table for rocking the lever and causing the table to move from lower to raised positions.

5. A device as set forth in claim 4 wherein the actuating rod means comprises a push rod, and a slide guide movably securing the push guide to the frame.

6. A device as set forth in claim 5 wherein the frame has an apex, and the slide guide and push rod are vertically disposed within the apex of the frame.

7. A device as set forth in claim 4 wherein the upper end of the elevating lever has an inclined surface for contacting the table to maintain it in its raised position for receiving an object being loaded upon it, and a support lug on a lower portion of the frame and extending in the lower path of movement of the table for supporting it in its lower position below the path of movement of the pusher with the object disposed in position for being traversed by the pusher through the blades.

8. A device as set forth in claim 1 wherein an apex connecting piece secures the ends of the longer side remote from the short side together.

9. A device as set forth in claim 1 wherein the three sides are disposed in a substantially right angular array in plan view, a longer side accordingly comprising a hypotenuse side of the frame in plan view, an intermediate length side carrying the slide and pusher and the short side comprising a base of the frame in plan view.

10. A device as set forth in claim 1 wherein removable clamp means is provided on a lower portion of the frame for securing it to a support table.

11. A device as set forth in claim 1 wherein the slide connecting means comprises a guide rod spanning its length, and sliding connectors connecting the pusher to the guide rod

12. A device as set forth in claim 11 wherein the slide connectors comprises roller bushings rotatably mounted on the pusher and engaging the slide guide bar.

13. A device as set forth in claim 1 wherein the pusher has a handle extending outwardly of the slide guide bar for actuating its movement back and forth.

* * * * *

UNITED STATES PATENT AND TRADEMARK OFFICE

CERTIFICATE OF CORRECTION

PATENT NO. : 4,184,397

DATED : January 22, 1980

INVENTOR(S) : Frank W. Jones

It is certified that error appears in the above-identified patent and that said Letters Patent are hereby corrected as shown below:

Column 1, line 17, "mounting" should read -- mounted --.

Column 1, line 19, "Spread" should read -- Spaced --.

Column 3, line 30, claim 3, after "length" change "." to --,--

Signed and Sealed this

*Fifteenth* Day of *July 1980*

[SEAL]

*Attest:*

SIDNEY A. DIAMOND

*Attesting Officer*

*Commissioner of Patents and Trademarks*